US005385812A

United States Patent [19]

Bagchi et al.

[11] Patent Number: 5,385,812

[45] Date of Patent: Jan. 31, 1995

[54] CONTINUOUS MANUFACTURE OF GELLED MICROPRECIPITATED DISPERSION MELTS

[75] Inventors: Pranab Bagchi, Webster; James T. Beck, Rochester; Vincent J. Flow, III, Kendall, all of N.Y.

[73] Assignee: Eastman Kodak Company, Rochester, N.Y.

[21] Appl. No.: 996,949

[22] Filed: Dec. 28, 1992

[51] Int. Cl.[6] ..... G03C 5/26

[52] U.S. Cl. ..... 430/449; 430/546; 430/642; 430/935; 430/631; 430/635; 430/628; 430/512; 430/517; 430/544; 252/306; 252/335

[58] Field of Search ..... 430/642, 546, 449, 935, 430/631, 635, 628, 512, 517, 544; 252/306, 335

[56] References Cited

U.S. PATENT DOCUMENTS

| | | | |
|---|---|---|---|
| 3,860,425 | 1/1975 | Ono et al. | 430/546 |
| 3,907,573 | 9/1975 | Franco et al. | 430/630 |
| 4,933,270 | 6/1990 | Bagchi | 430/546 |
| 4,970,139 | 11/1990 | Bagchi | 430/449 |
| 4,990,431 | 2/1991 | Bagchi et al. | 430/372 |
| 5,013,640 | 5/1991 | Bagchi et al. | 430/546 |
| 5,091,296 | 2/1992 | Bagchi et al. | 430/546 |
| 5,104,776 | 4/1992 | Bagchi et al. | 430/449 |
| 5,135,844 | 8/1992 | Bagchi et al. | 430/546 |
| 5,158,863 | 10/1992 | Bagchi et al. | 430/449 |
| 5,182,189 | 1/1993 | Bagchi et al. | 430/449 |
| 5,185,230 | 2/1993 | Bagchi et al. | 430/642 |

FOREIGN PATENT DOCUMENTS 2063695 6/1981 United Kingdom .

OTHER PUBLICATIONS

Research Disclosure, Item #308119, Dec. 1989.

*Primary Examiner*—Thomas R. Neville
*Attorney, Agent, or Firm*—Paul A. Leipold

[57] ABSTRACT

The invention discloses a continuous method of manufacture of gelled dispersion melts of "small-particle" microprecipitated photographic agents. The continuous melt manufacturing process of this invention provides dispersion melts that are invariant in agent concentration, melt viscosity, and turbidity as a function of the run time and are also very reproducible and robust in repetitive preparations. Many photographic melts of this invention exhibit high photographic activity and light stability of the agents when exposed to light.

19 Claims, 10 Drawing Sheets

EXAMPLE-19

COUPLER (Y-1) CONCENTRATION BY HPLC

CONTINUOUS MANUFACTURE OF GELLED MICROPRECIPITATED DISPERSION MELTS

FIELD OF THE INVENTION

The invention deals with the continuous manufacturing of gelled premelts for small-particle microprecipitated dispersions to obtain gelled premelts that are invariant in viscosity, coupler content, and turbidity with time, to provide a roboust and variability free product.

BACKGROUND OF THE INVENTION

R-1. Bagchi, P., "Process for the Precipitation of Stable Colloidal Dispersions of Base Degradable Components of Photographic Systems in the Absence of Polymeric Steric Stabilizers," U.S. Pat. No. 4,933,270.

R-2. Bagchi, P., "Methods of Preparation of Precipitated Coupler Dispersions With Increased Photographic Activity," U.S. Pat. No. 4.970,139.

R-3. Bagchi, P., Beck, J. T., and Crede, L. A., "Methods of Forming Stable Dispersions of Photographic Materials," U.S. Pat. No. 4,990,431.

R-4. Bagchi, P., Sargeant, S. J., Beck, J. T., and Thomas, B., "Polymer Co-precipitated Coupler Dispersions," U.S. Pat. No. 5,091,296.

R-5. Bagchi, P. and Sargeant, S. J., "Increased Photographic Activity Precipitated Coupler Dispersions Prepared by Coprecipitation With Liquid Carboxylic Acids," U.S. Pat. No. 5,104,776.

R-6. Bagchi, P., McSweeney, and Sargeant, S. J., "Preparation of Low Viscosity Small-Particle Photographic Dispersions in Gelatin," U.S. Pat. No. 5,013,640.

R-7. Bagchi, P., Edwards, J. L., Gibson, D., Rosiek, T. A., Thomas, B., and Flow, V. J., "High Dye Stability, High Activity, Low Stain and Low Viscosity Small-Particle Yellow Dispersion Melt for Color Paper and Other Photographic Systems," U.S. application Ser. No. 627,154.

R-8. Ono, Y., Yoneyama, H., and Ueda, H., "Dispersions Containing Surface Active Agents With Units of Polyoxyethylene and Polyoxypropylene," U.S. Pat. No. 3,860,425.

R-9. Kruyt, H. R., "Colloid Science," Vol. I & Vol. II, Elsevier, Amsterdam (1952).

R-10. Anonymous, "Photographic Silver Halide Emulsions, Preparations, Addenda Processing and Systems," *Research Disclosure,* 308, p. 933–1015 (1989).

R-11. Chen, B., "Laser Light Scattering," Academic Press, N.Y., 1974.

R-12. Barker, T. B., "Quality By Experimental Design," Dekker, N.Y., (1985).

R-13. Anonymous, "SAS User's Guide; Statistics," Version 5 Edition, SAS Institute, North Carolina (1985).

It has been known in the photographic arts to precipitate photographic materials, such as couplers, from solvent solution. The precipitation of such materials can generally be accomplished by a shift in the content of a water miscible solvent (R-1) and/or a shift in pH (R-2 to R-7). The precipitation by a shift in the content of water miscible solvent is normally accomplished by the addition of an excess of water to a solvent solution. The excess of water, in which the photographic component is insoluble, will cause precipitation of the photographic component as small particles. In precipitation by pH shift, a photographic component is dissolved in a solvent that is either acidic or basic. The pH is then shifted such that acidic solutions are made basic or basic solutions are made acidic in order to precipitate particles of the photographic component which is insoluble at that pH. Such precipitation techniques, in the absence of a latex polymer, lead to microprecipitated dispersions (R-1 to R-3 and R-5 to R-7). Such microprecipitated dispersions have been termed as "microprecipitated slurries" (MPS), as at this stage no gelatin has been added to the dispersion. The microprecipitated dispersions have relatively narrow particle size distribution compared to conventional milled dispersion prepared by milling in the presence of gelatin as described by Ono et al (R-8). Polymer co-precipitated (PCP) dispersions can be precipitated by similar pH-shift mechanism in the presence of a base-ionizing group combining polymer latex where, after precipitation, the photographic agent gets loaded inside the polymer latex particles (R-4). In PCP dispersions, the particle size is of the order of the polymer particles which can be anywhere between 50 to 800 nm.

Microprecipitated dispersions of the types mentioned above are generally prepared in the absence of gelatin. For the purpose of coating, it is necessary to add gelatin to such dispersions. It has been found earlier that small particle microprecipitated dispersions, when admixed with gelatin, produce excessive melt viscosities that are unsuitable for preparation of photographic coatings, single layer, or multilayer (R-6). There are two probable explanations for high viscosity of gelatin melts of such small-particle melts. The first cause is possibly due to the relatively higher increase in the excluded volume of the small-particle melts compared to conventional large-particle dispersions due to the presence of the gelatin adsorption layer as indicated in (R-6) column 3, line 38, as appended by reference. The second possible explanation lies in the much higher surface area of the small-particle dispersions. Conventional milled dispersions have relatively broad size distributions, and their mean diameters lie between 100 and 1000 nm, preferably between 100 and 400 nm. For the purpose of this invention, we define such conventional milled dispersions as "large-particle dispersions". MPS or PCP dispersions are usually much smaller in size and have very narrow size distribution. For the purpose of this invention, we define such dispersions with particle diameter smaller than 100 nm as "small-particle dispersions".

The specific surface area S (surface area per unit weight) of a dispersion system is given by:

$$S=6/\rho D \qquad \text{(I)}$$

where $\rho$ is the density of the particle and D is the mean diameter of the particles, assuming narrow size distribution. FIG. 1 illustrates the dependence of the specific surface area (with the approximation that $\rho=1.0$ g/cc) and the weight of gelatin needed to saturate the particle surface [assuming saturation gelatin adsorption is about 10 mg/m$^2$ as indicated in (R-6)], in the range of sizes covering both small- and large-particle dispersions. It is seen in FIG. 1 that for large-particle milled dispersions, saturation gelatin need is about 1 g gelatin per g of the dispersed medium. However, that for the small-particle dispersions, depending upon size, the saturation gelatin need is between 1.0 and 100 g of gelatin per g of the dispersed material. In a coating melt the ratio of gelatin to dispersed phase is between about 0.5 to about 2.0. Use of larger amounts of gelatin than the conventional range leads to thicker coating layers and, hence, loss of sharpness in the photographic product. Therefore, use of normal gelatin levels in small-particle dispersions leads to fractional surface coverage and, hence, "bridging" of dispersed particles (et. FIG. 2) which results in high viscosity melts. In older literature, bridging of particles have been described as "sensitized flocculation" (R-9).

The high viscosity problem has been solved by the use of certain viscosity-control surfactants to the gelatin solution before addition of the small-particle microprecipitated dispersion very rapidly (R-6 and R-7). It is hypothesized that the viscosity-control surfactants attach themselves to the hydrophobic segments of the gelatin molecule and the particle surface, and thus prevents or retards strong attachment of the gelatin molecule to particles by steric hindrance and thus essentially eliminate "sensitized flocculation". It has been pointed out in the prior art reference (R-7) that the mixing of the dispersion and the gelatin has to be fast in order to avoid sensitized flocculation. Fast mixing can be easily achived in small laboratory scale preparation of gelled melts. In production scale, where very large volumes of dispersion and surfactant gelatin solutions require mixing, normal mixing by addition of one solution to another can not be achieved very fast. It will be shown in the examples that when such addition and mixing is carried out, the turbidity of the resulting dispersion depends upon the rate of addition of gelatin. This leads to undesirable variability in production of the quality of the dispersion formed.

Microprecipitated dispersions have many advantages over conventional milled dispersions. Many solvent-free microprecipitated dispersions of photographic agents can provide dispersions that are much more active than their conventional milled analogs as described in references (R-3), (R-6), and (R-7). Other microprecipitated dispersions can be rendered active by incorporation of a polymer latex (R-6), high boiling coupler solvents (R-2), or liquid carboxylic acids (R-5). Many microprecipitated dispersions of photographic couplers produce dyes that are much more stable to fade compound to their conventional analogs (R-3), (R-6), and (R-7).

PROBLEM TO BE SOLVED BY THE INVENTION

There is a need for a substantially variability free gelatin melt making procedure for small-particle dispersions in manufacturing scale that will be quality improved and lower in cost for photographic products production. There is also a need to be able to manufacture and produce small-particle microprecipitated dispersion melts in large manufacturing scale that is substantially invariant in turbidity and viscosity, irrespective of the scale of the manufacturing procedures.

SUMMARY OF THE INVENTION

An object of the invention is to overcome disadvantages of prior photographic production processes and products.

An object of this invention is to reduce the cost of photographic products.

Another object of this invention is to provide a process of preparation of microprecipitated coupler dispersion melts that produce image dyes with greater stability from fading.

A further object of this invention is to provide a large-scale continuous manufacturing procedure for the preparation of gelled microprecipitated dispersion melts that produce low and invariant viscosity dispersion melts throughout the entire manufacturing procedure.

Another object of the invention is to provide a large scale continuous manufacturing procedure for the preparation of gelled microprecipitated dispersion melts that produce constant turbidity "floc-free" dispersion melts throughout the entire manufacturing procedure.

Generally the invention is accomplished by continuously providing a first flow of a small-particle microprecipitated slurry of a photographic agent in water and a second continuous flow of a gelatin solution at a constant rate and mixing the two solutions to continuously produce a gelled dispersion melt of the photographic material.

ADVANTAGEOUS EFFECT OF THE INVENTION

The invention has numerous advantages over prior processes for forming photographic materials. The dispersion melts of the invention have the advantage that they do not flocculate over time and produce dispersion melts of invariant activity and photographic characteristics. The continuous mixing of the invention causes the particles to be covered with gel without the use of a large amounts of gel in the dispersion. Therefore, there is virtually no flocculation, as the particles are covered with gelatin and surfactant, thereby remaining in the dispersion rather than coagulating and flocculating.

DETAILED DESCRIPTION OF THE INVENTION

The microprecipitated dispersions of this invention formed either by solvent or pH shift can be prepared by methods described in references (R-1) and (R-3) which are incorporated herein by reference. High boiling water immiscible solvent containing microprecipitated dispersion of this invention is prepared by procedure described in detail in reference (R-2), which is incorporated herein by reference. Procedure for the preparation of liquid carboxylic acid incorporated coupler particles for enhanced photographic activity is given in reference (R-5) and is hereby incorporated by reference. Microprecipitation of couplers and photographic agents inside polymer particles are described in reference (R-4) and are hereby incorporated by reference.

The types of surfactants that are suitable the stabilization of microprecipitated dispersions are given in references (R-1) through (R-7) and are also hereby incorporated by reference. Polymeric and oligomeric stabilizers useful for microprecipitated dispersions are also described in references (R-4), (R-6), and (R-7), which are hereby incorporated by reference.

Surfactants and materials that are suitable control of melt viscosity of small-particle microprecipitated dispersions containing gelatin are indicated in references (R-6) and (R-7). Preferred materials are set forth in the Examples.

The structures of photographic agents suitable for microprecipitation are described in detail in references (R-1) through (R-7) and are hereby incorporated by reference. Preferred materials are set forth in the Examples.

The latex polymers that are suitable for preparation of polymer co-precipitated dispersions, suitable for this invention are described in detail in reference (R-4) and is incorporated herein by reference.

The high boiling water immiscible solvents suitable for the preparation of such solvent incorporated microprecipitated coupler dispersions useful in this invention are described in detail in reference (R-2) and is hereby incorporated by reference. Preferred materials are set forth in the Examples.

The liquid carboxylic acids suitable for the preparation of increased activity microprecipitated dispersions of this invention are described in detail in reference (R-5) and is hereby incorporated by reference.

The low boiling water miscible auxiliary solvents that are useful in preparation of such microprecipitated dispersions of photographic agents of this invention are described in detail in references (R-1) through (R-7) and are hereby incorporated by reference. Preferred materials are set forth in the Examples.

Figure 1:
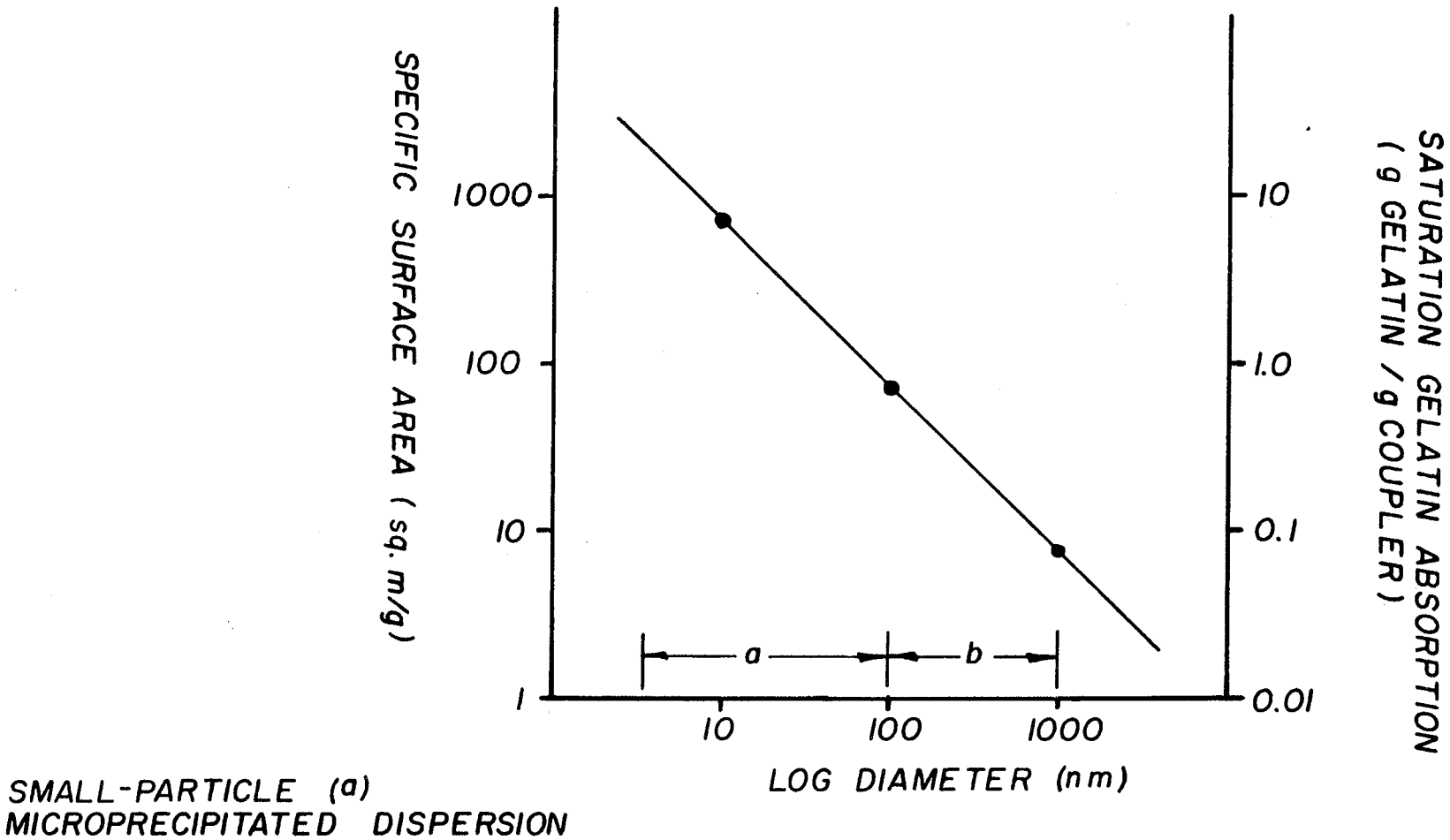
FIG. 1 illustrates the specific surface area and saturation gelatin need for both small-particle microprecipitated and large-particle milled dispersions as a function of particle diameter.
Figure 2:
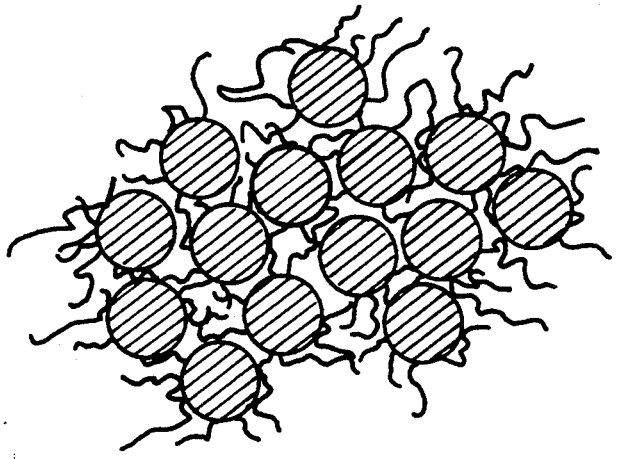
FIG. 2 illustrates a sensitized floc.
Figure 3:
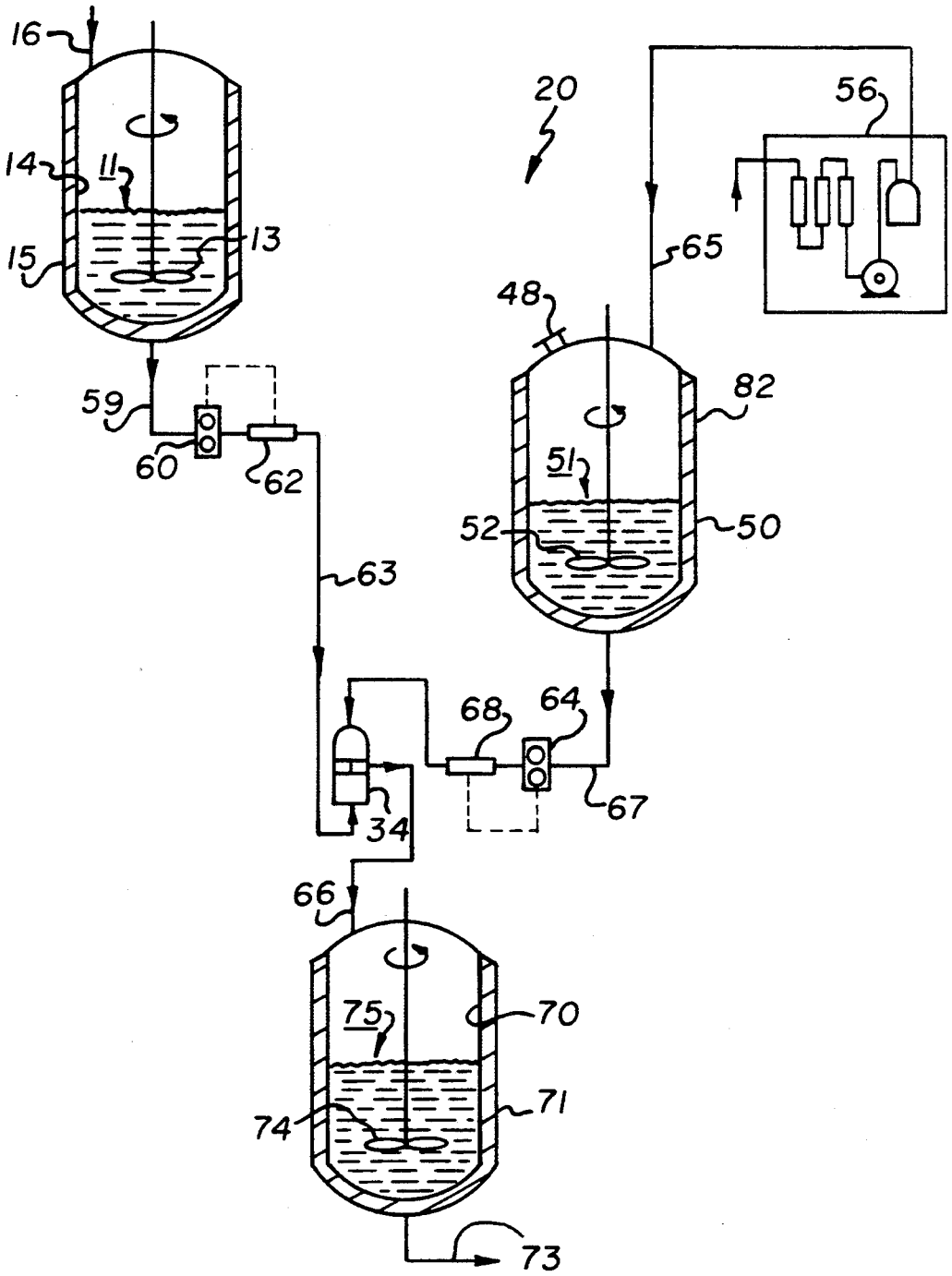
FIG. 3 illustrates the continuous melt preparation device of this invention.

FIG. 3 illustrates schematics of the device utilized in continuous preparation of the gelled microprecipitated small-particle dispersion melts of this invention. The word "melt" is used to describe a gelatin admixed photographic agent dispersion or emulsion. In the equipment 20 of FIG. 1, 56 is a water purification system to supply deionized water in the gelatin solution tank 82 through line 65. The gelatin tank 82 is fitted with stirrer 52 and a hot water heating jacket 50 which can render heat to raise the temperature of the content of tank 82 up to 60° C. to produce the gelatin solution 51.

Dry gelatin or moist gelatin (30–50% weight of gelatin) is added into the tank through manhole 48. Gelatin concentration in tank 82, depending upon the final melt gelatin concentration, can be up to about 20% by weight. The small-particle microprecipitated dispersion of this invention is pumped into the jacketed tank 14 through line 16. The hot water jacket 15 can raise the temperature of the MPS 11 up to about 60° C. The prop mixer 13 is utilized to slowly stir the slurry. The photographic agent concentration in the slurry can be up to 20% by weight. The gelatin solution from tank 82 is pumped into the mixing chamber 34, fitted with an electrically driven mixing device, using pump 64 through line 67 and micromotion flow meter 68. The pumping rate of pump 64 is adjusted to the desired value prior to the run to produce a melt of a desired gelatin concentration. The MPS from tank 14 is pumped into the mixing chamber 34, using pump 60 through line 59 and micromotion flow meter 62. The pumping rate of pump 60 is adjusted to the desired value prior to the run to produce the melt with a predetermined photographic agent concentration. The formed gelled dispersion melt flows through line 66 from the continuous mixer 34 into the jacketed tank 70 which is slowly stirred with prop 74. The hot water jacket 71 is utilized to keep the gelled melt 75 at the same temperature as that of tank 14 and 82 which are usually identical to each other. The product is removed for producing photographic coatings using line 73. The residence time in the mixing chamber 34 can be anywhere between about 0.1 to about 60 seconds, preferably between about 1 to about 10 seconds.

The particle diameter of the microprecipitated dispersion of this invention can be between 5 to 100 nm, preferably between about 5 and about 50 nm. The concentration of the microprecipitated dispersion can be anywhere between about 3% and about 20% by weight, preferably between about 8% and about 15%. The gelatin solution can be anywhere between about 5% and about 20% by weight of gelatin, preferably between about 8% to about 15%. The final dispersion formed can be anywhere between about 3% to about 15% by weight in photographic agent and about 3% to about 15% by weight of gelatin. The microprecipitated dispersion of this invention can be free of any solvent or contain about 0.2 to about 5 times of the weight of the coupler of a high boiling water immiscible coupler solvent or a liquid carboxylic acid or a latex polymer. The gelatin solution will contain a viscosity reduction surfactant in amounts that in the final formed gelled dispersion will be between about 0.1 and about 0.6 g per g of the photographic agent in the final dispersion melt. The flow rate of the gelatin and the coupler solution is greater than about 10 ml/min.

Paper System

This invention pertains to a layer structure as in current photographic paper (R-10) in the full color multilayer structure. The multilayer structure of a paper system is given in Table I. Such coatings are made in a simultaneous multilayer coating machine.

The solvents used in preparation of conventional prior milled dispersions are as follows:

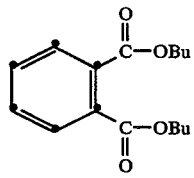

(SV-1)

$$CH_3-\overset{O}{\overset{\|}{C}}-O-CH_2-CH_2-O-CH_2-CH_2-O-Bu$$

(SV-2)

The proportions of these used in preparation of the dispersions will be given in the examples concerning prior milled control dispersions.

The yellow dye-forming coupler is (Y-1)

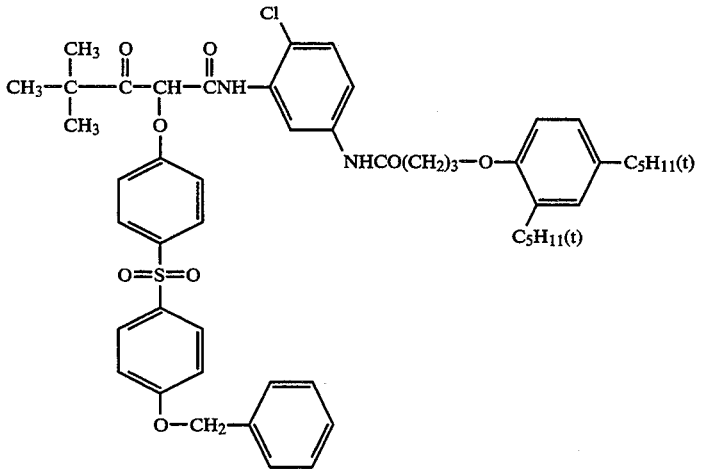

The magenta dye-forming coupler is (M-1)

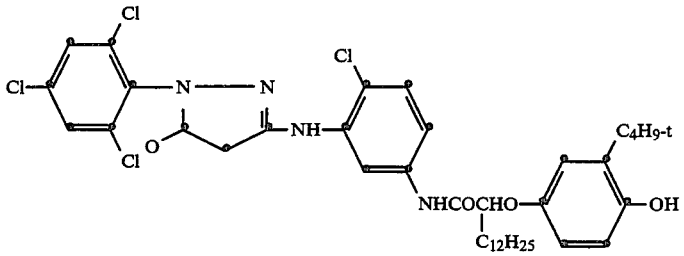

The cyan dye-forming coupler is (C-1)

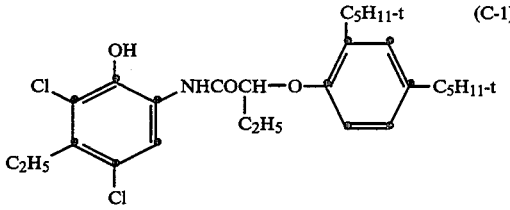

The surfactant utilized to prepare the conventional milled dispersion is Alkanol-XC.

Alkanol-XC

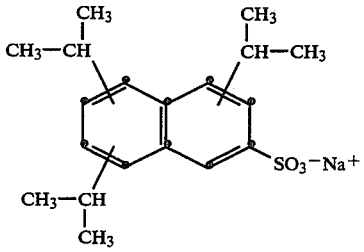

The incorporated oxidized developer scavenger used has the following structure:

(SC-1)

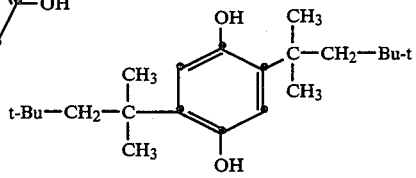

The stabilizer for the magenta dye has the following structure:

(ST-1)

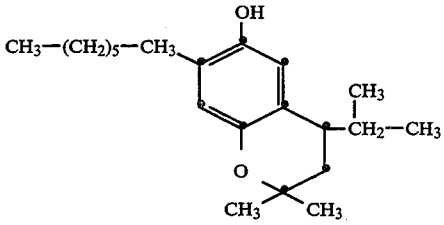

The ultraviolet radiation absorbing compounds utilized are the two following Ciba-Giegy compounds:

Tinuvin 326

(UV-1)

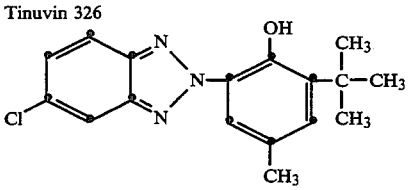

-continued

Tinuvin 328 (UV-2)

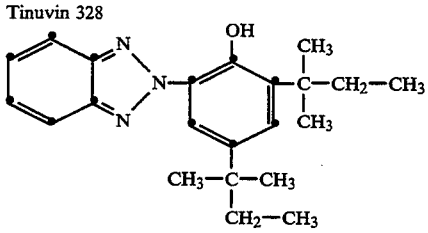

The specific dispersions prepared with these compounds will be described in detail in the appropriate examples.

The white light exposures of the coated films were made using a sensitometer with properly filtered white light (R-10) with a neutral step wedge of 0.15 neutral density steps. Color separation exposures were made similarly with properly filtered light. All processing was carried out using the well-known RA4 development process (R-10).

TABLE I

Layer Structure of a Model Multilayer Ektacolor Paper System
(Numbers indicate coverage in mg per square ft.)
(Numbers within " " indicate same in mg per square meter)

| | |
|---|---|
| | LAYER-7 |
| | Overcoat: |
| 125.0 | Gelatin; "1336" |
| 2.0 | (SC-1) (Conventional Scavenger Dispersed in Solvent); "21" |
| | LAYER-6 |
| | UV Protection Layer: |
| 61.0 | Gelatin; "653" |
| 34.3 | Tinuvin 328 (Co-dispersed) Ultraviolet light absorber; "364" |
| 5.7 | Tinuvin 326 (Co-dispersed) Ultraviolet light absorber; "60" |
| 4.0 | (SC-1) (Co-dispersed in Solvent); "43" |
| | LAYER-5 |
| | Red Layer: |
| 115.0 | Gelatin; "1230" |
| 39.3 | (C-1) (Cyan Cplr. Co-dispersed in Solv.); "420" |
| 0.5 | (SC-1) (Scavenger Co-dispersed in Solvent); "5" |
| 16.7 | AgCl (In Red Sensitized AgCl Emulsion); "179" |
| | LAYER-4 |
| | UV Protection Layer: |
| 61.0 | Gelatin; "653" |
| 34.3 | Tinuvin 328 (Co-dispersed); "364" |
| 5.7 | Tinuvin 326 (Co-dispersed); "60" |
| 4.0 | (SC-1) (Co-dispersed in Solvent); "43" |
| | LAYER-3 |
| | Green Layer: |
| 115.0 | Gelatin; "1230" |
| 41.5 | (M-1) (Magenta Coupler Co-dispersed in Solvent); "444" |
| 18.2 | (ST-1) (Stabilizer Co-dispersed in Solvent.: "195" |
| 3.4 | (SC-1) (Scavenger Co-dispersed in Solvent); "37" |
| 24.5 | AgCl (In Green Sensitized AgCl Emulsion); "262" |
| | LAYER-2 |
| | Inter Layer: |
| 70.0 | Gelatin; "749" |
| 9.0 | (SC-1) (Scavenger Dispersed in Solvent); "96" |
| | LAYER-1 |
| | Blue Layer: |
| 140.0 | Gelatin; "1498" |
| 100.0 | (Y-1) (Yellow Coupler Dispersed in Solv.); "1070" |
| 30.0 | AgCl (In Blue Sensitized AgCl Emulsion); "321" |
| | Support: |
| | Resin Coat: Titanox Dispersed in Polyethylene Paper |
| | Resin Coat: Polyethylene |

Monochrome yellow coatings contain oily layers 7, 6, 4, 1, and the support.

Description of Measurements and Processing

All particle sizes of the precipitated dispersions were measured by photon correlation spectroscopy (PCS) as described in (R-11). Unless otherwise mentioned, all step wedge exposure and photographic development were carried out by the standard RA-4 color development process described in (R-10) (Ektacolor Paper System [p. 26, a, b, and c]).

Solution reactivity rates of the dispersions were determined using an automated dispersion reactivity analysis (ADRA) method. A sample of the dispersion is mixed with a carbonate buffer and a solution containing CD-4 developer.

CD-4 Developer

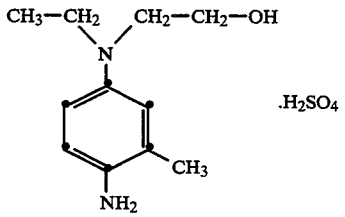

Potassium sulfite is added as a competitor. The carbonate buffer raises the pH of this reaction mixture to a value close to the normal processing pH (10.0). An activator solution containing the oxidant potassium ferricyanide is then added. The oxidant generates oxidized developer which reacts with the dispersed coupler to form image dye and with sulfite to form side products. After the addition of a clarifier (solution of Triton X-100), the dye density is read using a flow spectrometer system. The concentration of dye is derived from the optical density and a known extinction coefficient.

A kinetic analysis is carried out by treating the coupling reaction as a homogeneous single phase reaction. It is also assumed that the coupling reaction and the sulfonation reaction (sulfite with oxidized developer) may be represented as second-order reactions. Further, the concentrations of reagents are such that the oxidant and coupler are in excess of the developer. Under these conditions,-the following expression is obtained for the rate constant of the coupling reaction:

$$k=k'\ln[a/(a-x)]/\ln[b/(b-c+x)]$$

where k' is the sulfonation rate constant, a is the concentration of coupler, b is the concentration of sulfite, c is the concentration of developer, and x is the concentration of the dye. The rate constant k is taken as a measure of dispersion reactivity. From an independently determined or known value of k' and with this knowledge of all of the other parameters, the rate constant k (called the automated dispersion reactivity analysis, ADRA, rate) is computed.

EXAMPLES

The following examples are intended to be illustrative and not exhaustive of the invention. Parts and percentages are by weight unless otherwise specified, Coating laydowns are given in "mg/ft$^2$". Multiplication of these numbers by 10.7 will convert them to "mg/m$^2$".

Examples 1–5

Preparation of Conventional Milled Dispersions Utilized

The conventional milled dispersions of prior art utilized to demonstrate this invention with their compositions are listed in Table II, and the designated Examples are 1–5. These were prepared by known conventional milling procedures as illustrated in (R-8). The particle size of such milled prior art dispersions are usually broad and were on the average of diameter about 200 nm as measured by sedimentation field flow fractionation.

TABLE II

| Example # | Scavenger Coupler # or UV-Compound # | Photographic Agent Weight % | COMPOSITIONS OF CONVENTIONAL DISPERSIONS Coupler Solvent | Weight % of Coupler Solvent | Surfactant Name | Weight % of Surfactant | Stabilizer Compound | Weight % of Stabilizer Compound | Gelatin Weight % | Water Weight % |
|---|---|---|---|---|---|---|---|---|---|---|
| 1 | (Y-1) | 12.9 | (SV-1)<br>(SV-2) | 3.2<br>3.2 | Alkanol-XC | 0.9 | None | None | 8.8 | 71.0 |
| 2 | (M-1) | 8.7 | (SV-1) | 8.7 | Alkanol-XC | 1.0 | (ST-1)<br>(SC-1) | 3.7<br>0.9 | 8.7 | 76.3 |
| 3 | (C-1) | 9.5 | (SV-1)<br>(SV-2) | 5.2<br>0.8 | Alkanol-XC | 0.7 | (SC-1) | 0.03 | 9.5 | 75.1 |
| 4 | (UV-2)<br>(UV-1) | 11.8<br>2.1 | None | None | Alkanol-XC | 0.5 | None | None | 7.8 | 77.4 |
| 5 | (SC-1) | 5.9 | (SV-1) | 17.7 | Alkanol-XC | 0.2 | None | None | 8.9 | 67.3 |

It is to be noted that the dispersion of Example 4 does not contain any coupler solvent. The compounds (UV-1) and (UV-2) at elevated temperatures form an uteric mixture that is liquid and then can be dispersed in aqueous gelatin solution like other conventional dispersions.

Examples 6–9

Preparation of Small-Particle Micro-precipitated Slurry (MPS) of Yellow Dye-Forming Coupled (Y-1)

The MPS of yellow dye-forming coupler (Y-1) was prepared according to the method as described in references (R-3) and (R-6). The exact procedure and equipment is described in (R-6) in Example 1 of U.S. Pat. No. 5,013,640. The coupler P of U.S. Pat. No. 5,013,640 is the same as coupler (Y-1) of the instant examples. The physical characteristics of the MPS materials of Examples 6–9 are described in Table III.

TABLE III

| Example[c] | Concentration of (Y-1)[a] % | Diameter by PCS nm | ADRA Reactivity Rate L/Mol Sec |
|---|---|---|---|
| 6 | 13.4 | 16 | 13700 |
| 7 | 12.5[b] | 15 | 13100 |
| 8 | 12.5[b] | 16 | 12200 |
| 9 | 12.5[b] | 15 | 12100 |

[a]Determined by high pressure liquid chromatography (HPLC)
[b]Diluted to 12.5% with water after determination of (Y-1) concentration by HPLC
[c]All MPS materials were prepared using Aerosol A-102 (American Cyanamid) as described in U.S. 5,013,640

It is seen in Table III that the four batches of MPS materials were prepared with good reproducibility in particle diameter and their reactivities. These values are also very consistent with those described in (R-6).

Examples 10–18

Prior Art Batch Method of Preparation of Gelled Small-Particle MPS Melts of Dye-Forming Coupler (Y-1)

It has been indicated in references (R-6) and (R-7) that melts of MPS materials of the type of Examples 6–9 are prepared by heating it in a stirred tank to certain temperatures (between 40° C. and 60° C.) and then adding a solution of gelatin (lime processed ossein) of required concentration at the same temperature containing the viscosity control agent to the MPS. This can be achieved in small scale quite rapidly. In production scale when large quantities are involved, such addition and mixing cannot be very rapid. Therefore, a statistically designed experiment (R-12) was performed identify the major controlling factors for the gelatin melt-making process and identify the major sensitivities to its manufacturing process. The basic design was centered around the following central melt composition:

Lime Processed Ossein Gelatin 5% by weight
Coupler (Y-1) 8% by weight
Viscosity Control Agent APG-225 1.6% by weight [0.2 g/g of (Y-1)]

The factors examined and their ranges were as follows:

| | | |
|---|---|---|
| Gelatin Addition Rate: | 4.87 mL/min | → 29.2 mL/min |
| Mixing Rate: | 200 rpm | → 800 rpm |
| APG-225 Level: | 0.05 g/gram of (Y-1) | → 0.35 g/gram of (Y-1) |
| Temperature: | 40° C. | → 60° C. |
| Gel pH: | 5.50 | → 6.00 |

APG-225 is an alkylpolyglycoside surfactant manufactured by Henkel Corporation and has the following structure:

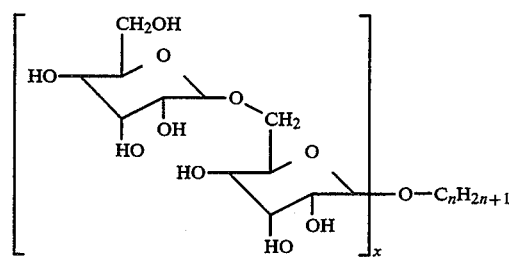

n is between 8 and 10 and x=1.8

The MPS material used in this experiment is that of Example 6 with 13.4% (Y-1).

The resulting melts were examined for liquid reactivity (ADRA), viscosity (VISY) and floc size. Turbidimetric (TURB) measurements were used to evaluate the relative differences in floc sizes of the flocs formed from the primary MPS particles during the melt-making process. Measurements were made both at 450 nm and 650 nm as well. Although both provided the same relative trends, the 450 nm data were used in the analysis because of the larger signals at this wavelength. The generated melts were also coated in monochrome format and evaluated for both fresh sensitometry and image stability after incubation. The primary data for this designated experiment are given in Table IV.

TABLE IV-A

| Primary Data of Melt Manufacturability Design Experiment | | | | | | | |
|---|---|---|---|---|---|---|---|
| Example | Addition Time (min) | Agitation Rate (RPM) | g APG-225 per g (Y-1) | Temp. (°C.) | pH | ADRA Rate (l/mol. sec) | VISY[a] cP (m ρ sec) |
| 10 | 35 | 500 | 0.20 | 50 | 5.75 | 7017 | 115.0 |
| 11 | 10 | 200 | 0.05 | 40 | 5.50 | 7353 | 565.0 |
| 12 | 60 | 800 | 0.05 | 40 | 5.50 | 7545 | 640.0 |
| 13 | 60 | 200 | 0.35 | 40 | 5.50 | 6154 | 26.5 |
| 14 | 10 | 800 | 0.35 | 40 | 5.50 | 6174 | 26.7 |
| 15 | 60 | 200 | 0.05 | 60 | 5.50 | 7375 | 463.0 |
| 16 | 10 | 800 | 0.05 | 60 | 5.50 | 7496 | 752.7 |
| 17 | 10 | 200 | 0.35 | 60 | 5.50 | 6335 | 27.3 |
| 18[b] (conventional control) | — | — | — | — | — | — | — |

TABLE IV-B

| Primary Data of Melt Manufacturability Design Experiment | | | | | | | | |
|---|---|---|---|---|---|---|---|---|
| | TURB (Turbidity) at | | | | | | Change in Density After Incubation[c] | |
| Example | 450 nm | 650 nm | $D_{min}$ | $D_{max}$ | Contrast | Speed | From 1.0 | From 1.7 |
| 10 | 0.309 | 0.069 | 0.085 | 2.15 | 2.59 | 175.7 | −0.10 | −0.16 |
| 11 | 0.246 | 0.057 | 0.086 | 2.14 | 2.59 | 176.3 | −0.10 | −0.19 |
| 12 | 0.336 | 0.084 | 0.084 | 2.07 | 2.56 | 175.8 | −0.10 | −0.20 |
| 13 | 0.268 | 0.054 | 0.087 | 2.13 | 2.58 | 175.2 | −0.11 | −0.20 |
| 14 | 0.254 | 0.053 | 0.088 | 2.13 | 2.57 | 175.1 | −0.12 | −0.21 |
| 15 | 1.899 | 0.647 | 0.085 | 2.12 | 2.57 | 176.4 | −0.12 | −0.19 |
| 16 | 0.516 | 0.134 | 0.086 | 2.11 | 2.56 | 176.2 | −0.11 | −0.19 |
| 17 | 0.353 | 0.078 | 0.086 | 2.17 | 2.62 | 175.7 | −0.12 | −0.20 |
| 18[b] (Conventional Control) | — | — | 0.073 | 1.89 | 2.07 | 165.2 | −0.28 | −0.73 |

Figure 4:
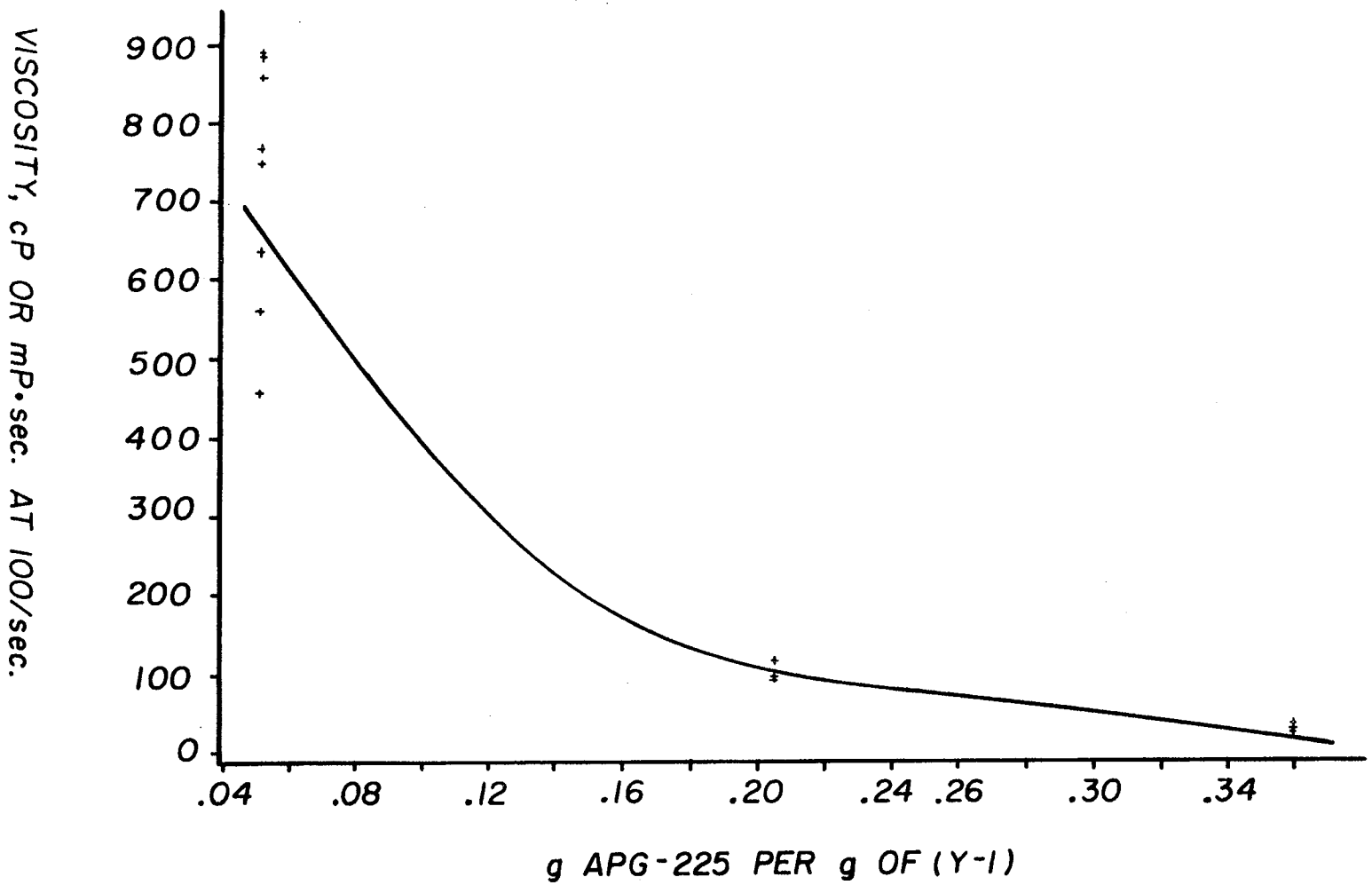
FIG. 4 illustrates the viscosity control effect of APG-225 on the viscosity of gelled "small-particle" dispersion melt coupler (Y-1).

[a]VISY is viscosity measured using a Brookfield Viscometer at shear rates of about 100/sec.
[b]Using conventional dispersion of (Y-1) of Example 1
[c]Image incubated at ambient temperature for 2 weeks under 50 Klux light intensity balanced for "daylight" lighting conditons The designed experiment data was analyzed by computational procedure "PROC GLM" provided by the SAS institute (R-13). The viscosity model was highly significant in the design space. As expected and known in prior art (R-6) and (R-7), the viscosity was overwhelmingly controlled by the level of the viscosity control agent APG-225 level, with pH and the interaction of APG-225 level*pH being significant. FIG. 4 shows this viscosity reduction effect of APG-225, or the gelled MPS melt of coupler (Y-1) as derived from this designed experiment.

The ADRA solution reactivites of Table III and Table IV indicate that gelled MPS melts have about half the reactivity as the slurry, slurry meaning dispersion before addition of gelatin. This is assumed to be due to the covering of the particle surface by gelatin. However, the ADRA reactivites of all the gelled MPS melts are about 3 to 4 times larger than that of the conventional milled dispersion of Example 1, which is about 1750 l/mole*sec.

Figure 5:
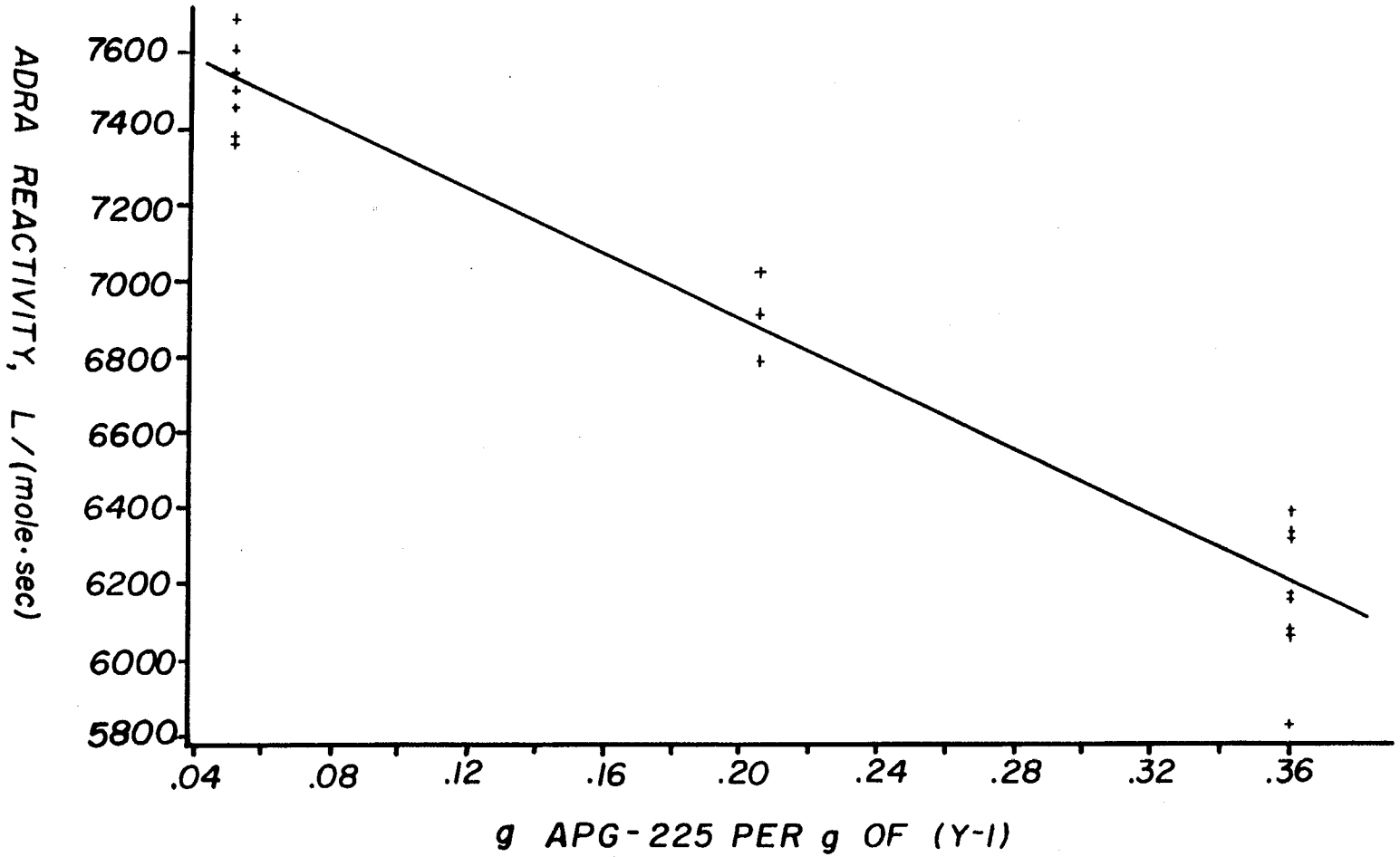
FIG. 5 illustrates the effect of the viscosity control agent APG-225 on the ADRA reactivity of the gelled MPS "small-particle" dispersion melts.

The incorporation of the viscosity control agent APG-225 into the dispersion melt of the MPS also has a significant but smaller effect on the solution ADRA reactivity of the dispersion melt. This is shown in FIG. 5. This is relatively smaller, but significant reduction in viscosity is also hypothesized to be due to the interaction of the APG-225 surfactant with the particle surface.

Results of monochrone coatings as indicated earlier of the melts of the designed experiment are also indicated in Table IV. As known earlier (R-6) and (R-7), the small particle MPS dispersion melts show significantly better $D_{min}$, higher $D_{max}$ and contrast and much improved dye stability over conventional milled dispersion of coupler (Y-1) of Example 1.

Figure 6:
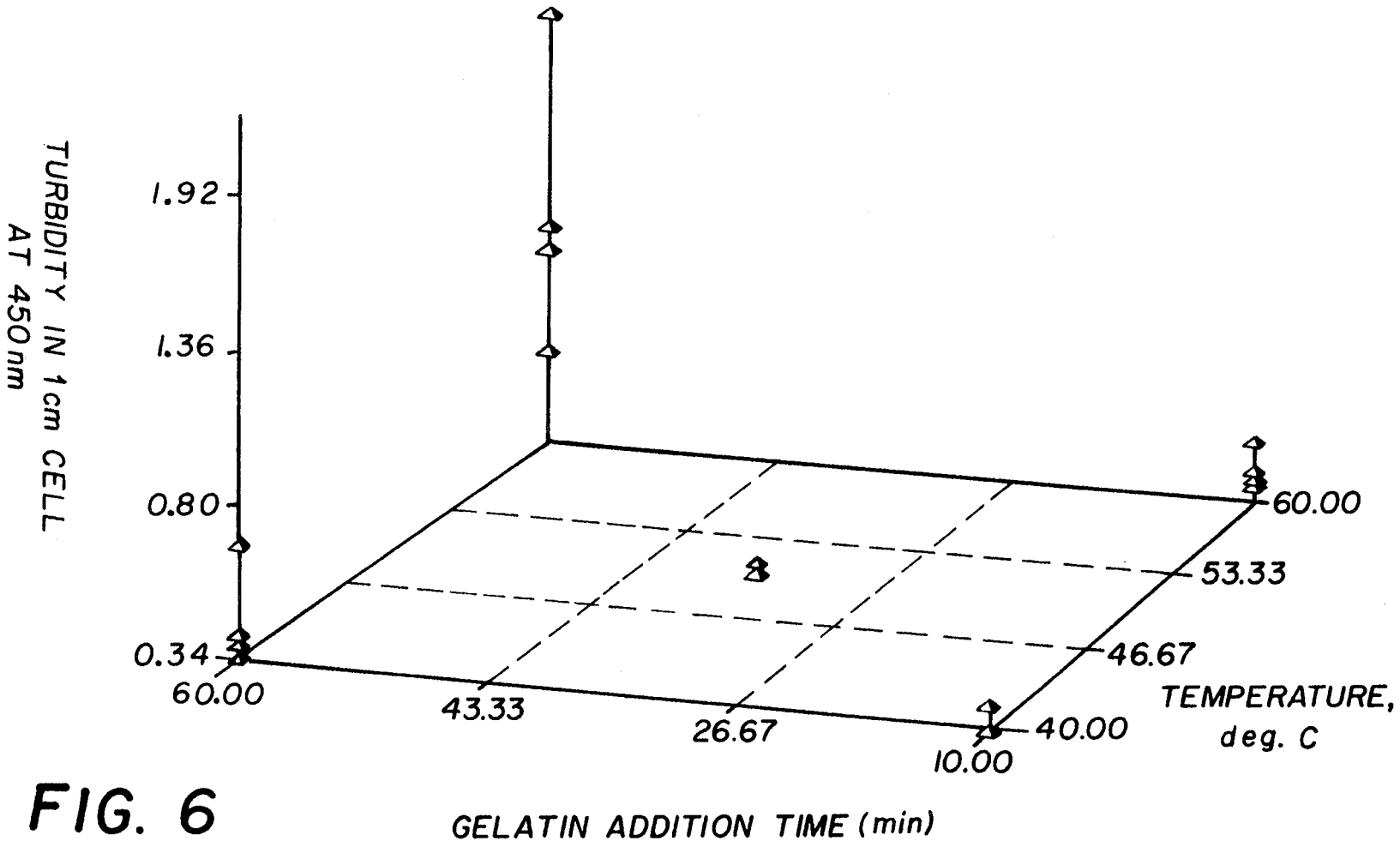
FIG. 6 illustrates the effect of gelatin addition rate and temperature on the turbidity of the formed dispersion melt, according to process of prior art.

FIG. 6 shows a three-dimensional plot of the turbidity (at 450 nm) as functions of gelatin addition time and temperature of the MPS, gelatin solutin, and the melt. It is clearly seen from this three-dimensional diagram that the gelatin addition time or the rate of gelatin addition has an extremely significant effect on the turbidity of the formed dispersion melt of the MPS material. It is to be noted that larger addition time meaning smaller addition rate. It is observed that at faster addition rates, this formed MPS melts have much smaller turbidity at all temperatures, whereas at very small addition times, the turbidities of the formed melts are extremely temperature dependent. This is an extremely undesirable feature in the manufacturing process. Therefore, there is a need for a more roboust melt manufacturing process that will lead to floc free, low turbidity dispersion melts in large scale where the extent of sensitized flocs or the turbidity of the formed gelled small-particle dispersion melt is very low and invariant with manufacturing time.

Examples 19–21

Inventive Continuous Method of Preparation of Gelled Small-Particle MPS Melts of Dye-Forming Coupler (Y-1)

The MPS materials of Examples 7, 8, and 9 were used to prepare the gelled microprecipitated small-particle dispersion melts by the continuous method of this invention, using the equipment of FIG. 3 by the process described earlier in the specification. The concentrations of the various solutions are indicated in the following:

16 Kg of the MPS material was placed in reacter 18 of FIG. 3 and heated with stirring to 45° C. A 10 Kg gelatin, APG-225 solution was prepared in reactor 82 using high purity water containing 1270 g of dry lime-processed ossein gelatin and 444.5 g of dry weight of APG-225. Stirred solution was held at 55° C. The coupler pump 60 was set at 620 g/min. and the gelatin solution pump 64 was set at 350 g/min. The stirrer in mixing chamber 34 was turned on, and the continuous melt-making process started by turning pumps 60 and 64 on simultaneously. The gelled dispersion was collected continuously in vessel 70. Samples of melt of size of about 10 g were collected every one minute from line 66 for testing. This formulation procedure had a theoretical aim of forming the MPS melt at 8.0% yellow coupler (Y-1), 5.0% of gelatin, and 1.6% of APG-225. After the passage of 16 Kg of the MPS, both the pumps 60 and 64 were turned off to terminate the melt-making process. This inventive melt example was designated in

Example 19

Figure 7:
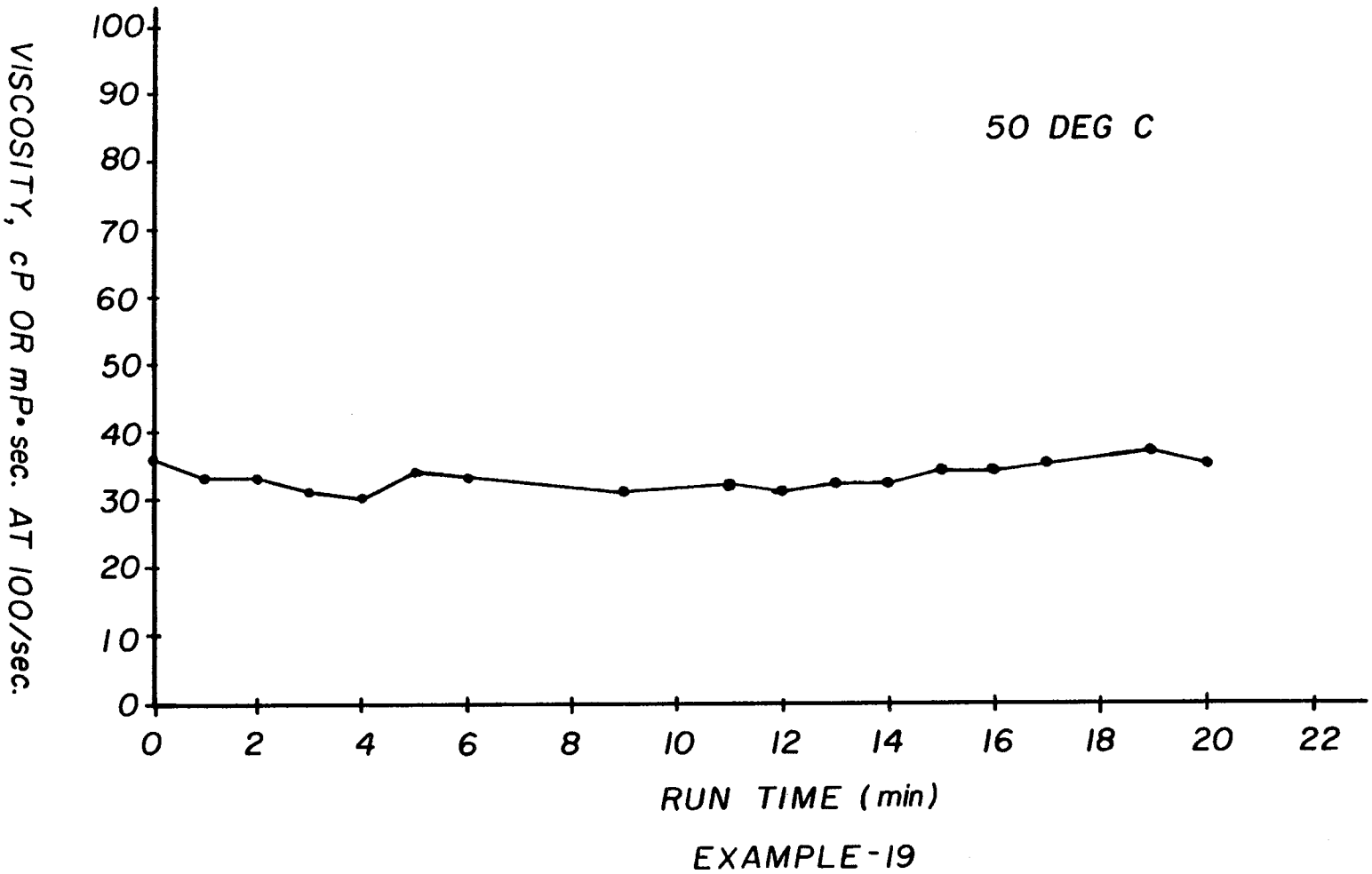
FIG. 7 illustrates invariance of melt viscosity as a function of manufacturing time in the continuous melt-making process of this invention.

Rheograms of all collected samples of the inventive dispersion melt collected were determined using a "Systems II" rheogoneometer (Rheometrics, Piscaltaway, N.J.) between shear rates of 0 and 100/sec. They were formed to be virtually independent of shear rate, indicating Newtonian behavior. The viscosity at 100/sec. of the collected samples as a function of run time is shown in FIG. 7. It is seen that within variability of the measurements, a constant low viscosity gelatin melt is formed all throughout the run. This provides an invariant and robust continuous melt manufacturing procedure.

Figure 8:
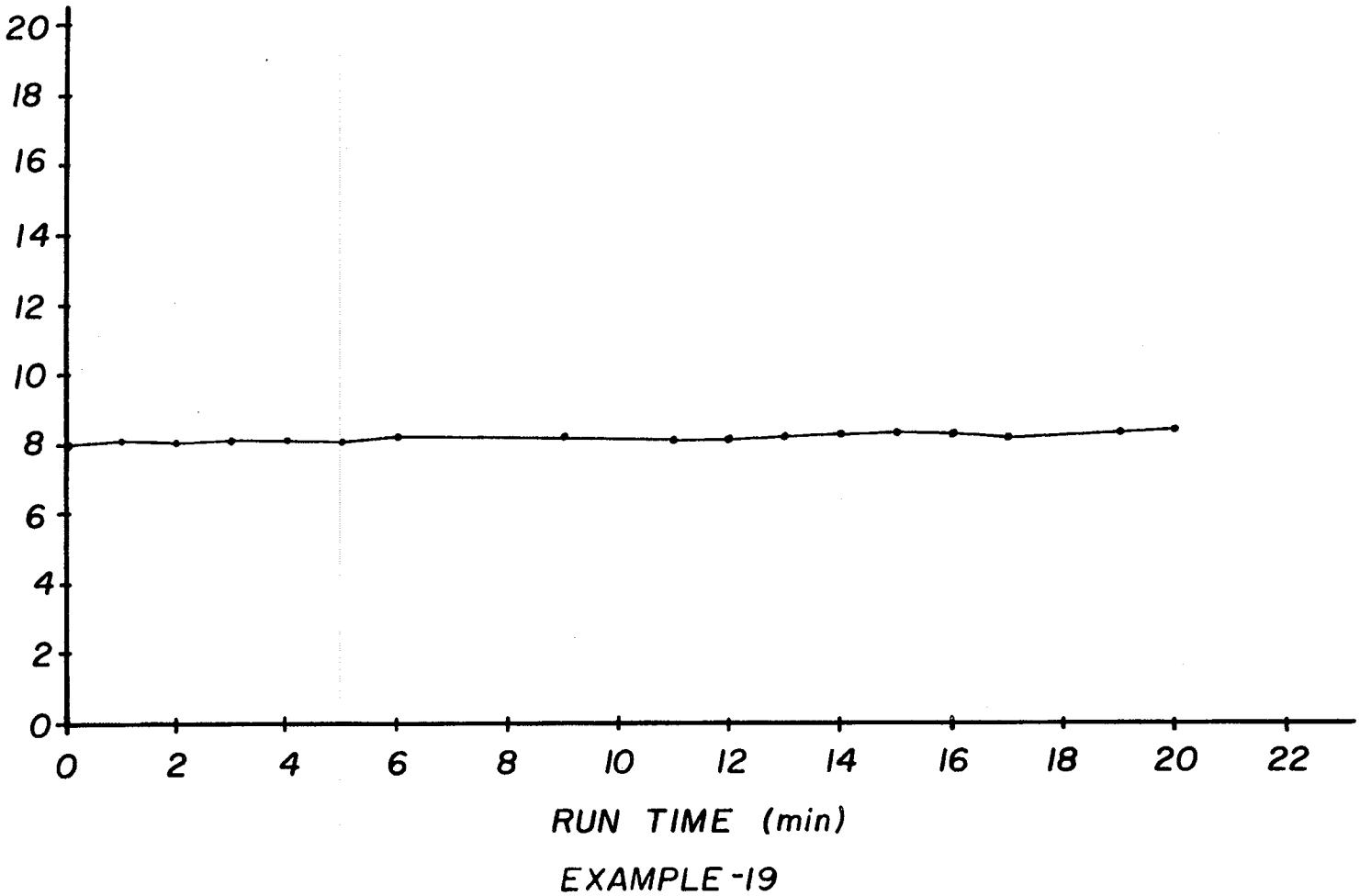
FIG. 8 illustrates the invariance of the product coupler concentration as a function of manufacturing time in the continuous melt-making process of this invention.

The concentration of the yellow coupler (Y-1) in all the collected samples were determined by high pressure liquid chromatography (HPLC). A time chart of the determinations is shown in FIG. 8, as gain, indicating the invariance and roboustness of the inventive melt manufacturing process. It is to be noted that the aim concentration of coupler (Y-1) is 8.0%. The formed dispersion shows virtually this concentration throughout the run.

Figure 9:
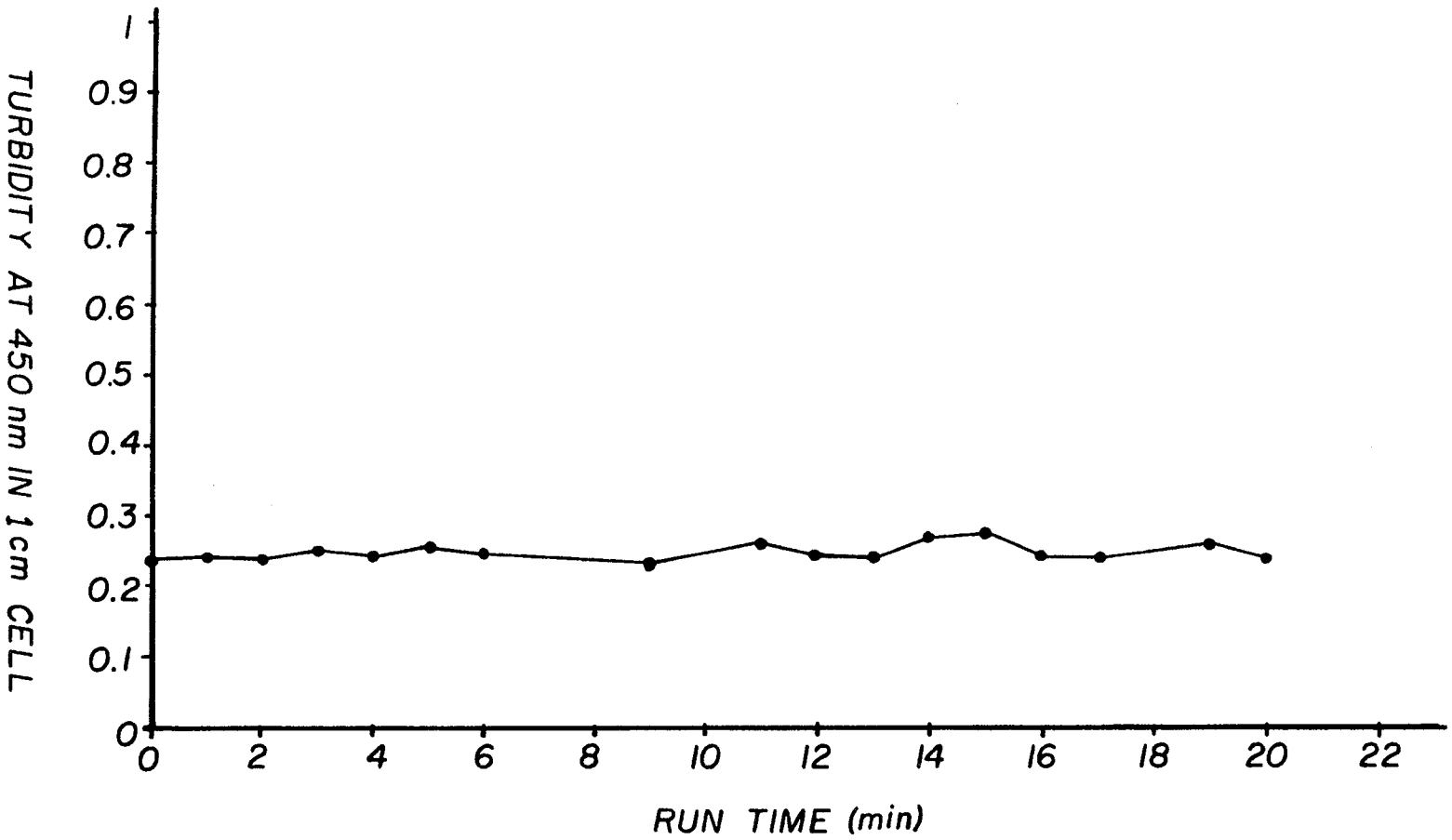
FIG. 9 illustrates the invariance of the product turbidity as a function of manufacturing time in the continuous melt-making process of this invention.

The turbidities of the individually collected samples were determined at 450 nm in a 1 cm cell. FIG. 9 shows a plot of the time chart of it as a function of run time. It is seen again that it is invariant within variability of the experiment throughout the run indicating an invariant and roboust manufacturing process compared to the prior art method of melt manufacturing of such "small-particle" dispersions.

The repeat preparations of gelled MPS melt of this invention were made. They were prepared identically as Example 19, except Example 21 was prepared with the viscosity control agent (R-6 and R-7), Pluronic L44, manufactured by BASF.

Pluronic L44

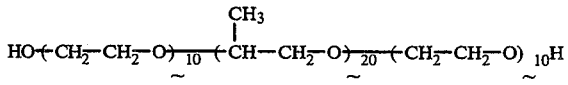

The characteristics of the three inventive dispersion melts are shown in Table V.

TABLE V

PHYSICAL CHARACTERISTICS OF GELLED DISPERSION MELTS OF THIS INVENTION

| Example | Aim Concentration of Coupler (Y-1) % | Aim Concentration of Gelatin % | Aim Concentration of Viscosity Control Agent % | Viscosity Control Agent | Final (Y-1) Concentration by HPLC % | Turbidity at 450 nm of Final Melt | Viscosity at 50° C. & at 100/nc in cPu mPsec of Final Melt | ADRA Reactivity Rate in L/mole-sec of Final Melt |
|---|---|---|---|---|---|---|---|---|
| 19 | 8.0 | 5.0 | 1.6 | APG-225 | 8.1 | 0.24 | 31 | 7520 |
| 20 | 8.0 | 5.0 | 1.6 | APG-225 | 7.8 | 0.21 | 31 | 7595 |
| 21 | 8.0 | 5.0 | 1.6 | Pluronic L44 | 8.0 | 0.25 | 20 | 8288 |

Figure 10:
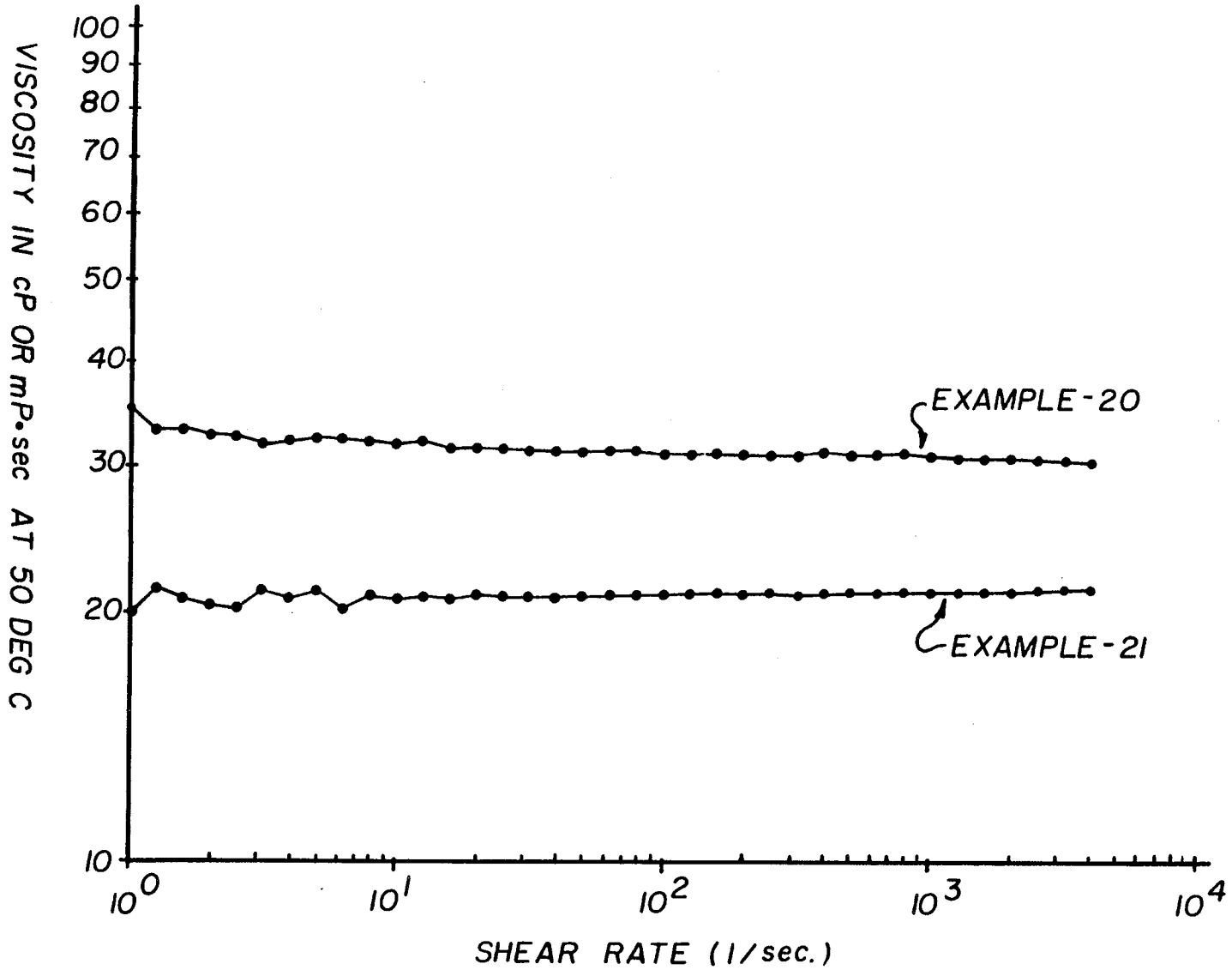
FIG. 10 illustrates the rheograms of melts of Examples 20 and 21.

It is seen in Table V that all the final MPS dispersion melts have final (Y-1) concentration pretty close to the aim concentration of 8.0%, very low turbidity values indicating floc free melts, and low viscosity values that are suitable for all types of production multilayer coating devices. FIG. 10 shows the rheograms of melts of Examples 20 and 21 in shear rate ranges between 0 and 5000/sec. It is seen that both the dispersions are virtually Newtonian, with virtually no shear rate dependencies, a property that is very suitable for single or multilayer coatings. It also is indicative of structure free (or floc free) dispersion. Similarly of viscosity values between melts of Examples 19 and 20 is indicative of roboust and reproducible manufacturing procedure of the invention.

Examples 22–27

Photographic Evaluation of the Dispersion Melts of Examples 20 & 21 of this Invention Full multilayer coatings in the EKTACOLOR PAPER format as indicated earlier in the instant specification were prepared by using multiple slide hopper 21" wide coating and drying machine system, using other necessary dispersions disclosed in Example 1. The inventive coatings were prepared using the "small-particle" microprecipitated dispersion melts of Examples 20 and 21. As indicated in Table VI, coatings were prepared at yellow dispersion (Y-1) coverage of 100 mg/ft$^2$ (1070 mg/m$^2$) and at 90 mg/ft$^2$ (963 mg/m$^2$). The strips were exposed through standard neutral step wedges and blue color separation filters, processed by KODAK RA-4 processing as described in reference (R-10). Results fresh sensitometry are shown in Table VI.

TABLE VI

Results of Photographic Testing of the Inventive Dispersions in Full Multilayer Coating Format

| Example | (Y-1) Gelled Dispersion Melt Example Numbers | Viscosity Control Agent | Laydown of Yellow Coupler (Y-1) mg/ft$^2$ (mg/m$^2$ | Fresh Blue Color Separation Sensitometry $D_{max}$ | $D_{min}$ | Relative Speed | Fade From Density 1.00 After Exposure to 84 Days at 5.4 Klux Exposure to Light Balanced for Daylight Condition |
|---|---|---|---|---|---|---|---|
| 22 (control) | 1 | None | 100(1070) | 2.187 | 0.099 | 160 | −0.60 |
| 23 (Invention) | 20 | APG-225 | 100(1070) | 2.271 | 0.086 | 165 | −0.41 |
| 26 (Invention) | 21 | Pluronic L44 | 100(1070) | 2.444 | 0.083 | 161 | −0.39 |
| 25 (Control) | 1 | None | 90(963) | 2.179 | 0.098 | 158 | −0.61 |
| 26 (Invention) | 22 | APG-225 | 90(963) | 2.234 | 0.085 | 164 | −0.44 |
| 27 (Invention) | 23 | Pluronic LA4 | 90(963) | 2.356 | 0.081 | 160 | −0.38 |

Results of Table VI indicate clearly that the inventive dispersions are far more active than the conventional control mat coatings. They also exhibit lower blue $D_{min}$ (stain). The photographic speeds of all the coatings are about the same. Dye stability data listed in Table V (last column) clearly indicate that the coatings prepared from the inventive dispersion mats show considerably greater light stability compared to the coatings prepared from the control melts with conventional dispersions. These superior photographic results provide utility of for instant invention.

The invention has been described in detail with particular reference to preferred embodiments thereof, but it will be understood that variations and modifications can be effected within the spirit and scope of the invention.

We claim:

1. A method of manufacture of gelled coating melts of small-particle microprecipitated dispersions of photographic materials comprising providing a first flow comprising a gelatin-free microprecipitated dispersion of a small-particle photographic agent having a particle diameter between 5 and 100 nm, providing a second flow comprising a solution of gelatin, a viscosity control surfactant and water, continuously mixing said first and second flow together to form a gelled dispersion melt for continuous coating of photographic products to produce floe-free and invarient viscosity melts, wherein the residence time of mixing of the first and second flows is between about 0.1 and about 10 seconds, wherein the flow rate of the first flow is at least about 50 ml per minute.

2. The method of claim 1 wherein said photographic agent is selected from the group consisting of dye-forming couplers, ultraviolet radiation absorbing materials, reducing agent developing agents, optical brightener, development inhibition releasing couplers, absorber filter dyes, and mixtures thereof.

3. The method of claim 1 wherein said photographic agent comprises photographic dye-forming couplers.

4. The method of claim 1 wherein said small-particle microprecipitated dispersion has a particle diameter between 5 and 50 nm.

5. The method of claim 1 wherein said small-particle microprecipitated dispersion comprises a preparation surfactant.

6. The method of claim 1 wherein said small-particle microprecipitated dispersion comprises a high boiling water immiscible permanent solvent.

7. The method of claim 1 wherein said small-particle microprecipitated dispersion comprises a liquid carboxylic acid.

8. The method of claim 1 wherein said small-particle microprecipitated dispersion comprises a polymer latex particle.

9. The method of claim 1 wherein said microprecipitated dispersion has a concentration between about 3% and about 20%.

10. The method of claim 1 wherein said microprecipitated dispersion has a concentration between about 8% and about 15%.

11. The method of claim 1 wherein said second flow comprises a gelatin concentration between about 5% and about 20%.

12. The method of claim 1 wherein said second flow comprises a gelatin concentration between about 8% and about 15%.

13. The method of claim 1 wherein said mixed flows comprise a gelatin concentration between about 3% and about 15%.

14. The method of claim 1 wherein said mixed flows comprise a photographic agent concentration anywhere between about 3% to about 15%.

15. The method of claim 1 wherein the said microprecipitated dispersion comprises about 0.2 to about 5 times the weight of the photographic agent of the material selected from the group consisting of a high boiling water immiscible solvent, a liquid carboxylic acid and a latex polymer.

16. The method of claim 1 wherein the amount of viscosity control surfactant in the mixed flow is anywhere between about 0.1 to about 0.6 times the weight of the photographic agent.

17. The method of claim 1 wherein the flow rate of the first flow is at least about 100 ml per minute.

18. The method of claim 16 wherein said viscosity control surfactant comprises

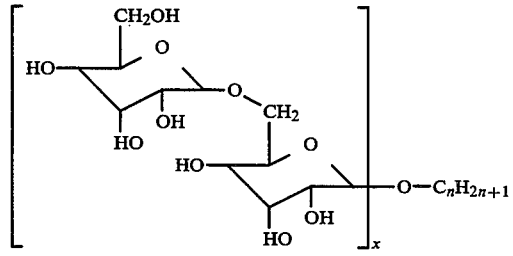

n is between 8 and 10 and x=1.8 or

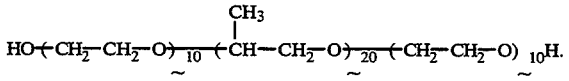

19. The method of claim 18 where said mixing is for a period between about 1 and about 10 seconds.

* * * * *